US005822904A

United States Patent [19]

Beal

[11] Patent Number: 5,822,904

[45] **Date of Patent: *Oct. 20, 1998**

[54] SUBSUOIC AMMUNITION

[75] Inventor: Harold F. Beal, Rockford, Tenn.

[73] Assignee: Cove Corporation, Knoxville, Tenn.

[ * ] Notice: This patent issued on a continued prosecution application filed under 37 CFR 1.53(d), and is subject to the twenty year patent term provisions of 35 U.S.C. 154(a)(2).

[21] Appl. No.: 815,003

[22] Filed: Mar. 14, 1997

[51] Int. Cl.[6] ..... F41A 21/12

[52] U.S. Cl. ..... 42/76.01; 102/430; 102/434; 102/464; 89/14.05

[58] Field of Search ..... 102/430, 434, 102/444, 447, 464, 465, 466, 467, 468, 446, 437; 42/76.01; 89/14.05, 14.4, 16

[56] References Cited

U.S. PATENT DOCUMENTS

| | | | |
|---|---|---|---|
| 290,738 | 12/1883 | Brown | 42/76.01 |
| 3,209,691 | 10/1965 | Herter | 102/464 |
| 4,644,865 | 2/1987 | Lawrence | 102/430 |

FOREIGN PATENT DOCUMENTS

| | | | |
|---|---|---|---|
| 80541 | 6/1951 | Czechoslovakia | 102/437 |
| 349795 | 9/1937 | Italy | 89/14.05 |
| 861718 | 2/1961 | United Kingdom | 42/76.01 |

*Primary Examiner*—Harold J. Tudor
*Attorney, Agent, or Firm*—Paul E. Hodges

[57] ABSTRACT

An ammunition cartridge for producing subsonic flight of a projectile therefrom at substantially all angles of fire relative to the horizontal, including an elongated, generally cylindrical case including a closed end containing a primer therein, a body portion suitable for the receipt of a quantity of gunpowder therein, and an open end suitable for receiving an elongated projectile therein. The case further includes a first stepped down stage at the open end thereof wherein the outer diameter of thereof is reduced by an amount sufficient to encircle at least a portion of the length dimension of the elongated projectile to thereby temporarily retain the projectile disposed in the open end of said case means prior to the firing of said cartridge, and at least one further stepped down stage disposed contiguous to said first stepped down stage and extending from said first stepped down stage in the direction of the closed end of said case means, the reduced diameter of said second stepped down stage being greater than the diameter of said first stepped down stage.

2 Claims, 2 Drawing Sheets

SUBSUOIC AMMUNITION

FIELD OF INVENTION

This invention relates to ammunition wherein the projectile thereof has a muzzle velocity of less than the speed of sound, i.e. subsonic, as the projectile leaves the weapon and during its free flight to a target. Particularly the invention relates to subsonic rifle ammunition.

BACKGROUND OF INVENTION

Most commonly, the projectile from a fired weapon, particularly a rifle, leaves the muzzle of the weapon at a speed that is greater than subsonic speed, i.e. at a muzzle velocity of greater than approximately 1086 ft/sec. at sea level under standard conditions of temperature and pressure. The faster a projectile travels, the flatter is its trajectory to its target. Also faster speeds of projectiles tend to reduce the effects of lateral wind forces upon the path of the projectile to its target. Therefore, for accuracy of delivery of the projectile to a desired target, commonly it has been the practice to maximize the quantity of powder used to project a given weight projectile to its target consistent with the permissible pressure for a given weapon. Supersonic muzzle velocities, therefore, are the norm for rifles.

Projectiles traveling at supersonic speeds generate an audible sound during their free flight to the target. This sound, and/or the sound generated by the projectile breaking the sound barrier, can be used to locate the source of the weapon from which the projectile was fired. Under certain circumstances of military operations and/or police operations, it is desirable that the source of the weapon firing a projectile not be identifiable by the sound generated by the traveling projectile. One partial solution to this problem is to restrict the speed of travel of the projectile to a subsonic speed.

A round of ammunition (often synonymously termed a "bullet" or a "cartridge") normally includes a case which includes a primer, a quantity of powder contained within the case, and a projectile held in the open end of the case. Upon the striking of the primer by the firing pin of the weapon there is generated a flame which serves to ignite the powder within the case, generating gases which expand and propel the projectile from the muzzle of the weapon. Normally, the case is geometrically shaped and sized to be contained within the chamber of the weapon, and the projectile is of a diametral dimension which allows it to fit in the breech end of the barrel, and to eventually pass through the barrel upon firing of the round. For many rifles, for example, it is common to make the case of the round of ammunition of a size which will provide for the maximumization of the force with which the projectile is propelled from the weapon to the target. Thus, it is common, for a round for a given caliber weapon, to employ a case which will contain a maximum amount of powder, hence the case has a large diameter relative to the diameter of the projectile employed. This case then becomes the "standard" case for a particular caliber weapon and weapons of this caliber are chambered to accept this standard case. Standards for the shape and size of a cartridge for a given weapon, e.g. a rifle, of a given caliber are established and published by Sporting Arms and Ammunition Manufacturers Institute (SAAMI).

In the many instances where the standard cartridge case is of a diameter which is substantially larger than the diameter of the bore of the weapon, that end of the case which receives and holds the projectile of the cartridge is "necked down" to a diameter suitable to engage and hold the projectile in the case. For example, the outer diameter of the case for a 0.224 caliber cartridge commonly is 0.360 inch, and the outer diameter of the projectile thereof is 0.224 inch. In any event, at least a portion of the projectile projects from the end of the case and is received within the breech end of the bore of the weapon. In this situation, the circular shoulder developed on the case by the necking-down operation serves as a point of reference for the insertion of the cartridge in the chamber of the weapon. Specifically, the chamber of the weapon is sized and shaped such that, when the cartridge is fully and properly inserted into the chamber, at least the juncture of the necked-down length of the case with the circular base of the shoulder engages the breech end of the barrel. With the cartridge in this position within the chamber, that portion of the projectile which projects outwardly from the end of the case is disposed within the bore of the weapon. Through adjustment of the length of that portion of the projectile which extends from the end of the case, it is possible to select the distance by which the projectile extends into the bore of the weapon. In all cartridges, the distal end of the projectile terminates at or short of the commencement of the rifling lands of the bore of the weapon.

Heretofore, it has been proposed to produce subsonic ammunition which comprises the "standard" case and projectile for a given weapon, e.g. a rifle, and to merely reduce the quantity of powder required to propel the projectile to that volume of powder which provides only sufficient energy to propel the projectile at a subsonic muzzle velocity. The round of ammunition thus produced looks and feels like a standard round of ammunition for its intended weapon, but it is only about 50% or less filled with powder, leaving a substantially portion of the interior volume of the case void of powder.

A major problem with this prior practice for the manufacture of subsonic ammunition relates to the reduced volume of powder within the case and the void volume within the case. Specifically, when the weapon is pointed (aimed) at a downward angle, relative to the horizontal, the powder within the case moves toward the leading end of the round and adjacent to that end of the projectile which is inserted into the case. This serves to form an air gap between the primer and the powder so that when the primer is struck by the firing pin, there is a finite time before the flame from the primer reaches and ignites the powder within the leading end of the case, and a finite time elapsing before the burning powder generates sufficient gases to propel the projectile from the weapon. Conversely, if the weapon is aimed upwardly, relative to the horizontal, the powder within the case moves toward the primer so that upon the firing of the primer there is instantaneous ignition of the powder and relatively quicker build up of the gases which propel the projectile from the weapon. At intermediate angles of aiming of the weapon, relative to the horizontal, there are corresponding intermediate delays in the time required for the projectile to be propelled from the weapon after the firing pin has struck the primer. These degrees of delay are extremely detrimental to the accuracy of delivery of the projectile to an intended target. In some circumstances, the delays in "firing" or "hang-fires" of the weapon have been sufficiently long as to deceive the shooter firing the weapon into believing that they have experienced a misfire. Suspecting a misfire, the shooter may open the bolt of the weapon to eject the suspected faulty round, whereupon the round may explode with obvious serious endangerment to the shooter.

In accordance with another aspect of the prior art subsonic ammunition, it has been the practice to use fast-burning powders, e.g. pistol powders. These powders exacerbate the problem of erratic propulsion of a projectile from the weapon by reason of the rapid build up of pressure within the case and the rapid fall-off of the pressure once the projectile leaves the case. As a consequence, the prior art subsonic ammunition fails to provide the energy needed to operate the bolt in a semiautomatic or automatic weapon and/or to lock the bolt in an open position upon the firing of the last round in the magazine.

Further, in the prior art subsonic ammunition, there has been no way for the shooter to differentiate between subsonic and supersonic rounds of ammunition for a given weapon aside from printed information on the container for the ammunition. As a result, subsonic ammunition has been fired when supersonic ammunition was intended, and vice versa.

SUMMARY OF INVENTION

The present invention comprises subsonic ammunition which fires with consistency from round to round, and which is identifiable by visual observation and/or tactilely. In accordance with one aspect of the present subsonic ammunition, there is provided a case having a rear end within which there is received a primer, and an opposite leading end which is open to receive therein a projectile. For a given caliber weapon, the projectile of the present invention is not materially changed from that which is commonly used with the weapon. However, the case of the present ammunition is provided adjacent its leading (open) end with a plurality of stepped stages, each of which reduces the effective diameter of the case, in stages, from the maximum outer diameter of the case to that diametral dimension which is adapted to accommodate the entry into, and proper anchoring of a projectile in the case. In short, there are multiple stages of reduction of the diameter of the case from its maximum outer diametral dimension to its minimum outer diametral dimension at its open, and leading, end. In this manner, a first one of the stages of diameter reduction reduces the outer diameter of the case, adjacent its open end, from its maximum value to a minimum reduced diametral dimension within which the projectile is received. The inner diameter of this first stage is determined by the outer diameter, i.e. caliber, of the projectile. A second one of these stages reduces the maximum outer diametral dimension of a portion of the length of the case to an intermediate diametral dimension. The effect of these multiple stages of reduced diameter of the case adjacent the open end thereof, is multi-fold. First, at least two of the diameter reductions are performed over approximately that length of the case which surrounds that length of the projectile which is disposed within the case. In the first stage reduction, the inner wall of the case and the outer wall of the projectile are in engaging relationship. In the second stage reduction, the inner wall of the case is disposed adjacent to, but not in engagement with, the outer wall of the projectile, thereby defining an annular space therebetween. The thickness of this annular space is chosen to preclude or limit the entry of powder into this space, thereby effectively reducing the amount of interior volume of the case which is available to receive powder therein. Thus, a given quantity of powder more nearly fills the available interior volume of the case and does not shift within the case as a function of the position of the weapon with respect to the horizontal. Second, the multiple stage diameter reductions impart a distinctive outer geometry to the case which is readily identifiable visually or tactilely.

In accordance with one aspect of the present invention, the powder employed in the present ammunition is a relatively slow burning type of powder. This powder provides a rapid peak in pressure build up within the case, but contrary to fast burning powders, the pressure build up produced by the present powder does not fall off sharply, but rather it platforms, so that there is available sufficient energy at the proper gas port location for operating the bolt of a semiautomatic or automatic weapon.

Still further, the circular shoulders that are formed internally of the case of the present invention have been found to function to buffer the peaking of the build up of pressure within the case upon firing to thereby cause the energy peak in the pressure build up within the case to be partially consumed in the deformation of the stepped portions of the case back to the geometry of the chamber. This results in a more uniform distribution of the pressure within the case such that there is a uniform thrust applied to the projectile, yielding consistency of projectile propulsion between rounds and a more lengthy column of uniform pressure in the barrel to enter the gas port and operate the bolt of a semiautomatic or automatic weapon.

Specifically, in accordance with one aspect of the present invention, in total, desirably, the staged diameter reductions effect a total reduction in available interior volume of the case by about 20%. Thereupon, the case is loaded with that quantity of powder which substantially fills the case with powder (i.e., that volume of the case which is not occupied by the projectile). The cartridge thus provided is of the same effective length as the cartridge heretofore employed with the given weapon, contains that quantity of powder therein so that it fires a projectile subsonically, fits within the existing chamber and barrel of the weapon, and exhibits consistency in powder ignition and burn, uniform and controlled pressure distribution and build up, hence consistency of accuracy of delivery of the projectile to a target, and functioning of a semiautomatic or automatic weapon which heretofore has not been possible. The interior open space of the cartridge is filled with sufficient gunpowder such that the cartridge fires uniformly at substantially all angles of fire relative to the horizontal. Only if the weapon is held substantially vertically downward when fired is there a possibility of the gunpowder in the present cartridge not being in immediate contact with the primer. "Hang-fires" are essentially eliminated. Additionally, the multiple stepped geometry of the case provides a means for ready visual or tactile identification of the round as being subsonic.

DETAILED DESCRIPTION OF INVENTION

Figure 1:
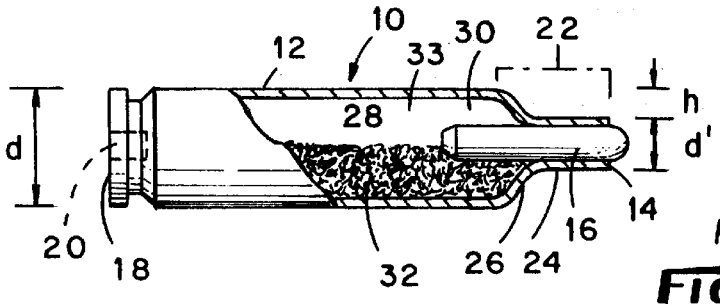
PRIOR ART Fig. 1
FIG. 1 is a schematic representation, partly in section, of a prior art subsonic cartridge.

With reference to the accompanying Figures, a subsonic cartridge 10 of the prior art is depicted in FIG. 1 and includes a case 12 having an open end 14 within which there is received an elongated projectile 16 and having a closed end 18 within which there is received a primer 20. The depicted case includes a single "necked down" stage 22 wherein the maximum diametral dimension,d, of the case is reduced to a diametral dimension, $d_1$. The stage 22 includes a straight cylindrical section 24, and a bell-shaped end section which includes a circular wall (i.e., shoulder) 26 that defines the transition of the cylindrical section 24 to the maximum (original) diametral dimension of the case. In the prior art, the height,h, of this wall equals the difference between the maximum outer diameter of the case and the outer diameter of the cylindrical section 24. The inner diameter of this stage 22 is such as permits the snug fit therein of the outer diameter of the projectile 16. In practice, the trailing end 28 of the projectile extends into the interior of the case. In a preferred embodiment of the present invention, all of the length of the projectile except a rounded blunt nose portion is disposed within the interior 30 of the case. The rounded blunt nose portion of the projectile length projects from the open end 14 of the case.

Figure 2:
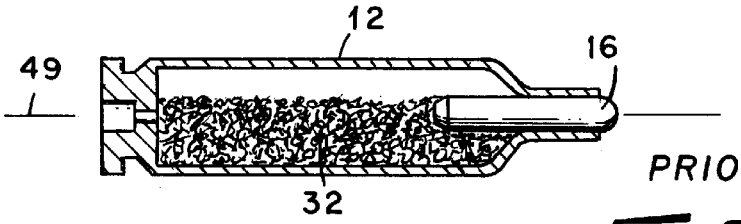
PRIOR ART Fig. 2
FIG. 2 is a schematic representation, in section, depicting a prior art subsonic cartridge when oriented with its longitudinal centerline parallel with the horizontal.
Figure 3:
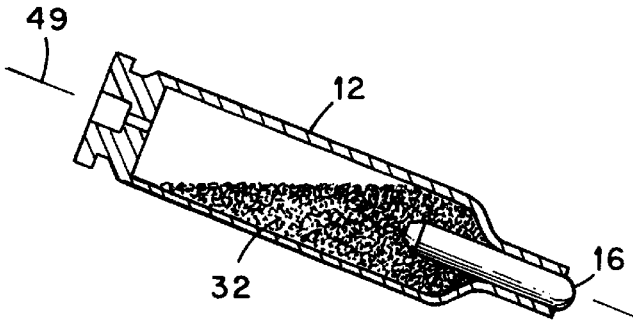
PRIOR ART Fig. 3
FIG. 3 is a schematic representation, in section, of the cartridge of FIG. 2 when oriented with its longitudinal centerline angularly downwardly from the horizontal.
Figure 4:
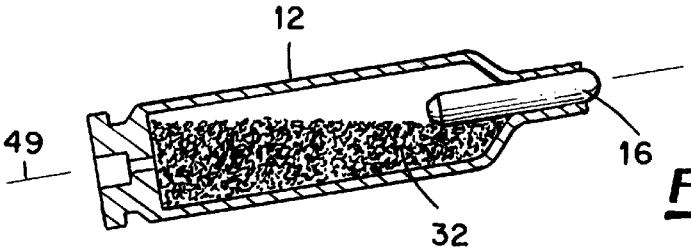
PRIOR ART Fig. 4
FIG. 4 is a schematic representation, in section, of the cartridge of FIG. 2 when oriented with its longitudinal centerline angularly upwardly from the horizontal.
Figure 5:
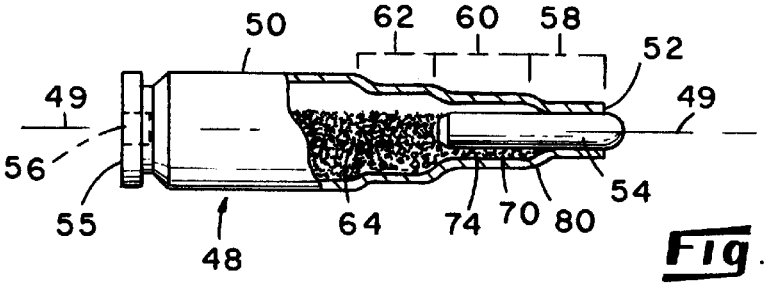
FIG. 5 is a schematic representation, partly in section, of a subsonic cartridge embodying various of the features of the present invention.

Within the prior art case depicted in FIG. 1 there is provided a quantity of powder 32 which is sufficient only to propel the projectile from the weapon at a subsonic muzzle velocity. As noted in FIG. 1, this quantity of powder does not completely fill the interior volume of the case which is available to receive powder after the projectile has been disposed within the case. Commonly, in the prior art, approximately 60% or less of the available interior volume of the prior art case is filled with powder, leaving a void volume 33 interiorly of the case. Accordingly, when the cartridge of FIG. 1 is tilted relative to the horizontal, the powder within the case flows toward one or the other ends of the case, depending upon the angle of tilt relative to the horizontal. FIGS. 2–4 depict a prior art subsonic cartridge when oriented with its longitudinal centerline parallel to the horizontal (FIG. 2) and at various angles relative to the horizontal (FIGS. 4 and 5). When the cartridge is tilted downwardly (FIG. 3), the powder within the case flows toward the projectile, and away from the primer, thereby requiring that the primer flame travel through open space within the case before igniting the powder. When the cartridge is tilted upwardly as in FIG. 4, the powder flows to the primer end of the cartridge so that when the primer is fired, the powder is ignited without delay. These circumstances create inconsistent ignition of the powder, inconsistent build up of pressure within the case and barrel, and inconsistency in the accuracy of delivery of the projectile, among other problems.

Figure 6:
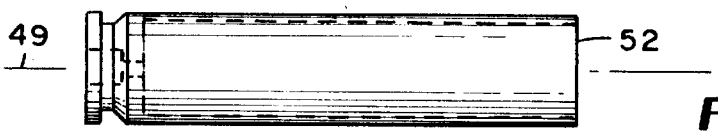
FIG. 6 schematically depicts one embodiment of a case having no stepped stage.
Figure 7:
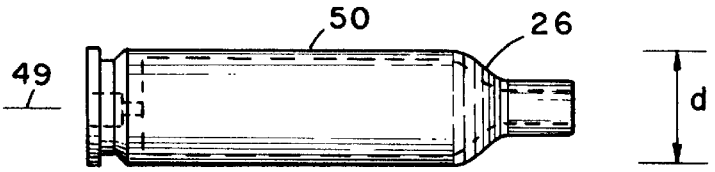
FIG. 7 schematically depicts a case having a single stepped stage.
Figure 8:
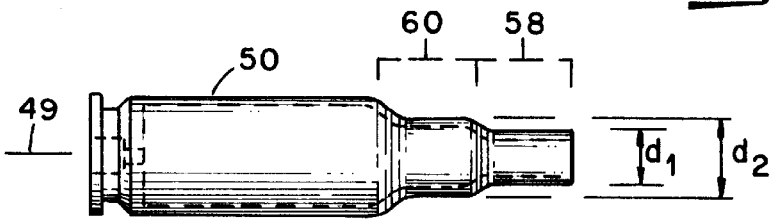
FIG. 8 schematically depicts a case having two stepped stages in accordance with the present invention.
Figure 9:
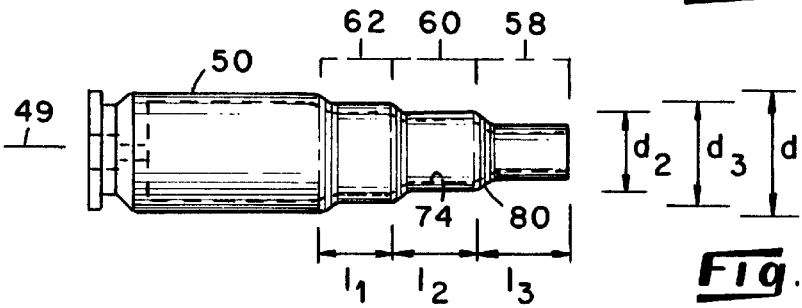
FIG. 9 schematically depicts a case having three stepped stages in accordance with the present invention.
Figure 10:
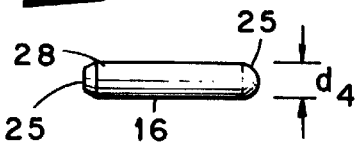
FIG. 10 schematically depicts a typical projectile employed in a subsonic cartridge of the present invention; and, FIG. 11 is a schematic representation, in section of one embodiment of a round of ammunition having three necked-down stages and depicting the directionality of the forces internally of the case created by burning of powder within the case.

With specific reference to FIG. 5, in the depicted embodiment of the present invention, there is provided an improved subsonic round 48 of ammunition including an elongated substantially cylindrical case 50 having a longitudinal centerline 49 an open end 52 within which there is received an elongated projectile 54, and having a closed end 55 within which there is received a primer 56. In contrast to the case depicted in FIG. 1, the case 50 of FIG. 5 includes a plurality of "necked down" stages, namely a first stage 58, a second stage 60 and a third stage 62. Referring to FIGS. 6–8, the outer maximum diametral dimension,d, of the case is reduced to a first reduced diametral dimension, $d_1$, to define the first "necked-down" stage 58. The length,l, of this first stage, measured along the longitudinal centerline 49 of the round is a function of the standard sizing of the chamber of a particular caliber weapon. In a 0.223 caliber weapon, the length of the first stage will be about 0.18 inch. The case is further "necked-down" by reducing its diametral dimension, d, to a second reduced diametral dimension, $d_2$, to define the second "necked-down" stage 60. The length of this second stage is generally a function of the length of that portion of the projectile which is disposed within the case. Desirably, the length of the second stage extends along at least a major portion of the trailing end of the projectile within the case. In those instances where there is an inordinate length of the projectile disposed within the case, as desired, one or more further "necked down" stages may be employed, each such stage serving to further reduce the internal volume of the case which is available to receive powder. In the instance where the trailing end of the projectile extends beyond the combined lengths of the first and second stages, a third "necked down" stage may be employed to define a further annulus between the inner wall of the third stage and that portion of the outer wall of the projectile which is encircled by the inner wall of the third stage. It is understood that there may be provided third, fourth, etc., stages irrespective of the length of the projectile. In the instance of a third stage, the case is further "necked-down" by reducing its diametral dimension, d, to a third diametral dimension, $d_3$, to define the third "necked-down" stage 62. The individual length of this third stage, and the individual length of any further stage, preferably is substantially equal to the length of the second stage to provide uniform geometry of the second and third, and any further, stages. Of course, each stage is larger in size than its preceding stage.

The inner diameter of the first stage 58 is such a permits a snug fit therein of the outer circumference of the projectile 16. As noted, in practice, almost all of the projectile extends into the interior of the case, with only the rounded blunt nose of the projectile projecting from the open end of the case.

The second stage 60 defines an annulus 70 between the inner diameter 72 of the case and the outer diameter,$d_4$,of that portion of the projectile which is surrounded by the second stage 60 of the case. Importantly, the inner diameter of the second stage 60 of the present case is established at a value which will distance the interior wall 74 of the case apart from the outer circumference of that portion of the projectile which is surrounded by the second stage 60 such that there is no engagement of the case wall of the second stage with the projectile. Preferably the thickness of the annulus is such that essentially no powder particles can move into the annulus 70 formed between these inner and outer diameters, or the quantity of powder which might enter the annulus is of no material effect upon the pressure build up upon firing of the powder within the case.

The overall length of the case 50 of the present invention is equal to the overall length of the case 12 of the prior art cartridge, for the same caliber weapon. Linear extension of a standard case may occur by the action of forming the stages of reduced diameters. This increase in overall length of the case, if it occurs, is readily rectified by trimming the open end of the case to a proper overall length prior to inserting a projectile into the case.

The projectile of the present invention is essentially identical to the projectile employed in the prior art subsonic cartridge for the same caliber weapon. In this manner, the case of the present invention is received within the chamber of the weapon with its first "necked-down" stage 58 and the exposed end of the projectile being received in the breech end of the chamber of the weapon. To utilize the present cartridge in a weapon, therefore, requires no modification of the weapon. The shoulder 80 formed at the juncture of the first and second stages 58 and 60 serves to engage the breech end of the chamber of the weapon to indicate and ensure that the cartridge has been properly received within the chamber.

On the other hand, the interior volume of the case 50, when the projectile is mounted in the open end thereof, which is available to receive powder, is between about 10% and about 20% less than the available interior volume of the prior art cartridge. In this manner, the present inventor has found that the case of the present invention can be made to be substantially filled with powder and still obtain subsonic velocity of the projectile. By this means, the present round will fire consistently from round to round, the powder will ignite and burn uniformly, and the projectile will be propelled from the barrel at a subsonic muzzle velocity.

By reason of the stepped exterior geometry of the present cartridge, a shooter may readily distinguish the present subsonic cartridge from the normal supersonic cartridge for a given weapon. This recognition is possible merely by visually examining the exterior of the present cartridge or by tactile examination of the exterior of the cartridge, this latter identification method being of importance in low light or dark shooting conditions.

Referring to FIGS. 6–8, in one example of a subsonic round of ammunition manufactured in accordance with the present invention, a case 50 of the type available commercially and comprising a substantially straight cylinder having a longitudinal centerline 49 and an open end 52 (FIG. 6) preferably is provided with a first "necked down" stage 58 (FIG. 7) employing a first forming die, and thereafter provided with a second "necked down" stage 60 employing a second forming die. As desired the case may further thereafter be provided with a third "necked-down" stage 62, employing a third forming die. The procedures for forming a single "necked down" stage are well known in the shooting art and involve placing the case in a forming die and applying pressure in a direction substantially parallel to the longitudinal centerline of the case to force the case into the die and form a "necked down" stage. Heretofore, it has been the practice only to form a single "necked down" stage adjacent the open of the case for the sole purpose of receiving and holding a projectile within the open end of the case. As desired, a single forming die having internally stepped stages may be employed to form the first, second and third stages in a single die forming operation.

As noted, the inner diameter of the second "necked down" stage 60 is greater than the inner diameter of the first "necked down" stage 58. The combined lengths of the first and second stages commonly, and preferably, substantially equals that length of the projectile 16 which is received in the open end 52 of the case. That is, that end of the second stage nearest the rear end of the case is substantially coterminal with the trailing end of the projectile within the case. Recalling that the inner diameter of the first "necked down" stage of the case is substantially equal to the outer diameter of the projectile, it will be recognized that the second "necked down" stage, having an inner diameter that is greater than the outer diameter of the projectile, in cooperation with the projectile encompassed by the second stage of the case, forms an annulus 70 (FIG. 5) surrounding that portion of the length of the projectile which is surrounded by the second stage. The extent of reduction of the diameter of the case at the second stage is chosen such that the annulus 70 has a thickness which is not materially greater than, and preferably less than, the average particle size of powder employed in the cartridge, thereby preventing any material amount of the powder from entering the annulus. This set of conditions effectively reduces the available interior volume of the case by a first amount. Importantly, the inner wall 74 of the second stage 60 does not engage the outer wall of the projectile so as to inhibit the movement of the projectile from the case upon firing of the weapon.

The interior volume of the first stage is occupied by the projectile and therefore is not available to receive powder. The diameter of any third stage is chosen to be less than the original diameter of the case, but greater than the diameter of the second stage. In this manner, the interior volume of the case which is available to receive powder therein is reduced by a second amount. The combined first and second amounts of reduction in the available interior volume of the case are designed to reduce the overall available interior volume of the case to between about 80% and about 90% of its original available volume, the available volume being defined as the original volume of the case less the volume within the first stage.

Figure 11:
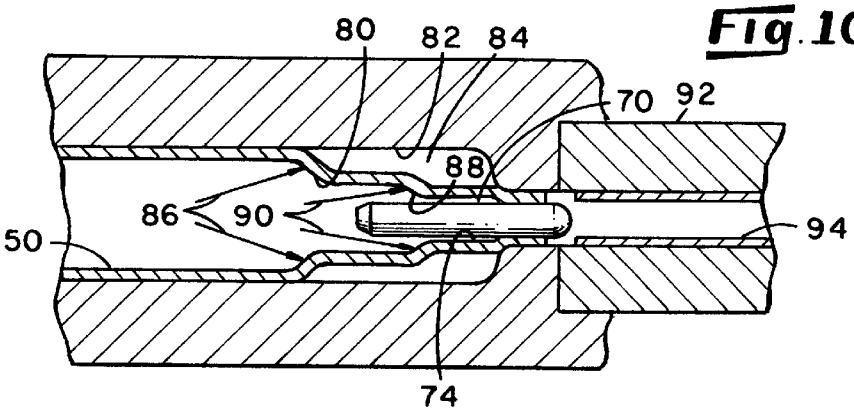

In the formation of the several stepped stages of the case of the present invention, it is preferred that the extent of diameter reduction per each of the second and third stages be uniform over the number of stages. For example, if the maximum outer diameter of the case is to be reduced, in two stages, to a minimum diameter, then the overall reduction in diameter of the case to be accomplished by the second and third stages would be divided by two to determine the amount of diameter reduction per stage. In this manner, there is provided uniformity of reduction of the case diameter from stage to stage (disregarding the first stage which is filled by the projectile). This factor is of importance in controlling the build up of gas pressure within the case prior to and/or after the projectile has been propelled from the case and/or the barrel of the weapon. More specifically, the present inventor has found that upon the ignition of the slow burning powder by the fired primer, the gas build up within the case commences adjacent the primer and progresses along the length of the case and eventually along the length of the barrel 92. Referring to FIG. 11, as this pressure build up reaches the internal circular shoulder 80 formed by the third stage of diameter reduction, the pressure commences deformation of the shoulder toward the inner wall 82 of the chamber 84 of the weapon in the direction of the arrows 86 of FIG. 11. Substantially instantaneously, the build up of pressure within the case also commences deformation of the internal circular shoulder 88 formed by the second stage of diameter reduction in the direction of the arrows 90 of FIG. 11. This deformation of the case in these areas consumes energy in a gradual manner, thereby causing the internal shoulders to function in the nature of pressure buffers that reduce the rate of pressure build up within the case and thereby tend to make the pressure build up more uniform. This uniformity of pressure build up enhances the control over the propulsion of the projectile from the weapon, thereby ensuring that the projectile does not exceed subsonic velocity. This control over the pressure build up not only has been found to eliminate pressure excursions within the case 50 and weapon barrel 92 which could propel the projectile supersonically, but also permits one to maximize the amount of powder employed for a given round of ammunition to thereby have available adequate pressure for operation of the bolt of a semiautomatic or automatic weapon. Successful control over the pressure build up as noted, is enhanced by selecting the extent of diameter reduction per stage to be uniform between stages as described herein.

In one example of a cartridge embodying the present invention, a 5.56 mm (0.223 caliber) cartridge for the M16 rifle was prepared. In this cartridge, the original outer diameter of the case was 0.36 inch. This case, as received from the manufacturer, was 1.76 inches long overall, had a wall thickness adjacent its open end of 0.012 inch, and included a first "necked down" stage which had an outer diameter of 0.244 inch and an inner diameter of 0.22 inch. This first stage extended from the open end of the case along the length of the case a distance of about 0.18 inch. This case was die formed to produce a second "necked down" stage which had an outer diameter of about 0.264 inch, and which extended from the first stage along the length of the case a distance of about 0.35 inch. Thereafter the case was further die formed to produce a third "necked down" stage having an outer diameter of 0.320 inch. This third stage extended from the second stage along the length of the case a distance of about 0.35 inch. All cartridges cases were chosen for uniformity of construction. All projectiles were crimped in their respective cases employing a uniform crimping procedure and pressure.

The case was provided with a primer and loaded with 10.2 grains of N540 gunpowder from Vihta Vuori Oy. Thereafter, a 126 grain projectile formed from a mixture of tungsten and lead powders, cold-compacted to a density of between 11.6 and 12.4 and encased in a copper jacket, was inserted into the open end of the case. This projectile possessed a flat end 25 which was inserted into the case and a rounded blunt end 27 which projected from the open end of the case. The projectile was 0.85 inch in length, had an outer diameter of 0.224 inch, and substantially all of the projectile was received within the case, aside from the blunt rounded nose (about 0.015 inch length) of the projectile which was disposed within the barrel 92 to a terminus just short of the breech ends of the lands 94 of the barrel when the cartridge was disposed within the chamber 84 in position for firing. After the projectile had been inserted into the case, approximately 80% to 90% of the interior volume of the case that was not occupied by the projectile was filled with the powder. This powder had an average particle size such that essentially no powder was able to enter the 0.008 inch thick annular space between the internal diameter of the second stage of the case and the outer diameter of the projectile.

Multiple ones of the cartridge of the above example were produced and fired using an unmodified M16–M4 military rifle. Firing was conducted in semiautomatic mode and in automatic mode employing various barrel lengths. In both modes of operation, the projectiles of the present cartridges left the muzzle of the weapon at subsonic speeds and, in both modes of operation, at the end of a firing cycle (i.e. all cartridges in the magazine were fired), the bolt of the weapon was locked in the open position. There were no failures of proper bolt operation during either of these modes of operation.

What is claimed:

1. The combination of a gun and a gun ammunition cartridge for the leveling of the buildup of gas pressure within said gun ammunition cartridge upon the firing of the cartridge while contained in the firing chamber of the gun comprising, a gun having a firing chamber and a barrel which includes a breech end portion and a firing chamber disposed adjacent said breech end portion of said barrel and including a generally cylindrical body portion having an inner wall and a tapered shoulder transition portion between and connecting said body portion of said firing chamber and said breech end portion of said barrel, a gun ammunition cartridge in said firing chamber including an elongated case having a closed end, a generally cylindrical main body portion, an open leading end and at least first and second tandem stepped down stages adjacent said leading end, each of said stepped down stages including a generally cylindrical body portion having an outer wall and a tapered shoulder transition portion having an outer wall, said tapered shoulder transition portion of said first stepped down stage being disposed between and connecting said body portion of said first stepped down stage and said body portion of said second stepped down stage and said tapered shoulder transition portion of said second stepped down stage being disposed between and connecting said body portion of said second stepped down stage and said main body portion of said cartridge, said body portion of said second stepped down stage having a diameter greater than a diameter of said body portion of said first stepped down stage and lesser than a diameter of said body portion of said firing chamber, whereby there is defined an open continuous annular space between said inner wall of said firing chamber adjacent said breech end of said barrel and said outer walls of said body portion and tapered shoulder transition portion of said second stepped down stage, an elongated projectile within said leading end of said case, said projectile extending into said case to a terminus inwardly of said case a distance not less than about coterminal with said second tapered shoulder transition portion of said case, whereby there is defined a continuous annular space between the projectile and the generally cylindrical body portion and tapered shoulder transition portion of the second tandem stepped down stage, an inner surface of said body portion of said first stepped down stage encircling at least a portion of the length dimension of said elongated projectile to thereby retain said projectile disposed in said leading end of said case prior to the firing of said cartridge, whereby said tapered shoulder transition portion of said second stepped down stage is expandable into said open continuous annular space upon the firing of said cartridge to absorb at least a portion of the energy accompanying any pressure spikes associated with the firing of said cartridge.

2. The combination of claim 1 and including a third tandem stepped down stage adjacent said main body portion of said cartridge case, a body portion of said third tandem stepped down stage having a diameter greater than the diameter of said body portion of said second tandem stepped down stage and lesser than the diameter of said firing chamber.

* * * * *